United States Patent [19]

Baumann

[11] Patent Number: 4,750,220

[45] Date of Patent: Jun. 14, 1988

[54] DUAL STAGE FLUSH LIFTER

[76] Inventor: Robert Baumann, One Anchorage Way, Freeport, N.Y. 11520

[21] Appl. No.: 865,425

[22] Filed: May 21, 1986

[51] Int. Cl.[4] ..... F03D 1/14

[52] U.S. Cl. ..... 4/324; 4/405; 4/415

[58] Field of Search ..... 4/324, 325, 405, 415

[56] References Cited

U.S. PATENT DOCUMENTS

| | | | |
|---|---|---|---|
| 2,609,546 | 9/1952 | Gulick | 4/405 |
| 4,141,092 | 2/1979 | Jones | 4/324 |
| 4,175,296 | 11/1979 | Goldman | 4/325 |
| 4,225,987 | 10/1980 | Goldman et al. | 4/324 |
| 4,406,024 | 9/1983 | Chiu et al. | 4/324 |
| 4,411,029 | 10/1983 | Huang | 4/324 |
| 4,530,119 | 7/1985 | Chiu et al. | 4/324 |

*Primary Examiner*—Henry J. Recla
*Assistant Examiner*—Linda J. Sholl
*Attorney, Agent, or Firm*—Bauer & Schaffer

[57] ABSTRACT

A toilet flush tank mechanism having a lifting rod for raising a ball actuated by a pair of handles attached to the lifting rod on the exterior of the water tank. One of the handles is fixedly secured to the lifting rod to conjointly move therewith and the other of the handles is secured to the lifting rod so as to be initially rotatable freely about the lifting rod over a predetermined arc and thereafter causes the conjoint movement of the lifting rod with it.

14 Claims, 2 Drawing Sheets

DUAL STAGE FLUSH LIFTER

BACKGROUND OF THE INVENTION

The present invention relates to apparatus for flushing toilet water tanks and in particular to a mechanism for controlling the amount of water discharged from the water storage tank.

In general, toilet water storage tanks have an enlarged outlet in their bottom walls, discharging water into the toilet bowl. A discharge valve, commonly referred to as the "ball", is normally seated in the outlet, and is attached at one end to a lifting rod, which is bent at its other end to pass through the front wall of the tank. The exterior end of the lifting rod is provided with a knob or handle, by which the user manipulates the lifting rod causing the ball to unseat from the outlet. The raised ball falls back into place automatically as the water in the tank is discharged.

Associated with this mechanism is a water supply allowing water from an external source to refill the tank. In conventional operation, the entire amount of water stored in the tank is discharged upon each operation of the lifting rod, even though only a fraction of that quantity of water may be actually required for flushing the waste material from the toilet bowl. As a result, unnecessary water consumption occurs which not only overburdens the municipal waste disposal systems, but results in an unnecessary comsumption of water.

Many attempts have been made to conserve water used in the flushing operation, particularly by controlling the degree or extent of actuation of the lifting rod and/or discharge ball valve. Among such attempts are those that specifically provide the lifting rod with two handles, one which activates the lifting rod fully and the other which actuates the lifting rod only partially, consequently causing the ball to fall back into place and seat on or in the discharge opening before the flush tank is fully emptied. Reference can be made to U.S. Pat. Nos. 3,988,786; 4,141,092; 4,175,296; 4,225,987; and 4,406,024; 4,411,029; and 4,530,119, each which show dual handle devices.

Each of the devices shown in the foregoing patents requires, in addition to the two handles, plural concentric spindles or shafts passing through the wall of the flush tank as well as complex structures for connecting the respective spindles to the lifting rod and thereafter for controlling the degree of rotative manipulation of the handles and/or the degree of lift imparted by the lifting rod to the ball. Sometimes a second lifting rod is required. These devices have not found commercial favor because of their complexity and the need to modify the tank construction and/or the flush mechanism, all of which prohibitively raises the cost of any installation.

It is an object of the present invention to provide an improved apparatus for controlling the operation of flushing apparatus for toilets and particularly to a mechanism by which the amount of water being discharged can be selectively controlled and reduced.

It is another object of the present invention to provide a control mechanism for toilet flush apparatus which may be readily attached to the conventional devices without major modification or change therein.

Various other objects together with numerous advantages of the present invention will be apparant from the following disclosure.

SUMMARY OF THE INVENTION

According to the present invention, a toilet flush apparatus is provided wherein a single lifting rod for raising the ball valve is actuated in each of two extents or degrees of arc by a respective one of a pair of handles. One of the handles is fixedly secured to the lifting rod so that it causes the primary actuation of the lifting rod while the other of the handles is connected to the lifting rod so as to be relatively rotatable with respect to or about the rod. This enables a predetermined arc of relative lost motion after which the other hand actuates the lifting rod so as to cause the flushing operation thereof. As a result, the lifting rod may be provided with a shorter flushing effect or stroke by the second handle while still providing a normal or conventional full flush or stroke with the first handle.

In the present invention, the dual handles are both connected to the single lifting rod without the use of any intermediate spindles or complex mechanism connecting the handles to the lifting rod. The primary handle is fixed directly to the lifting rod for simultaneous conjoint movement in the conventional manner. The auxiliary or second handle, on the other hand, is provided with a hub loosely fitting about for rotation relative to the lifting rod. A pin and slot arrangement provided on the rod and hub of the second handle effects lost motion connection therebetween.

Preferably, a stop means is provided to limit the movement of the primary handle within a predetermined arc which permits the full raising of the ball relative to the discharge outlet while the auxiliary handle is provided with a connecting bar that similarly engage with its own associated stop means to predeterminately limit its arcuate extent of movement and the consequent amount of flush water discharged from the tank.

It is contemplated, according to the present invention, that the stop means be provided on the conventional bushing that passes through the front wall of the water tank within which the lifting rod is itself journaled. The exterior of the bushing is preferably formed with stops that are arcuately spaced from each other which engage cooperating stops on the primary and secondary handles.

Full details of the present invention are set forth in the following description and are illustrated in the accompanying drawings.

DESCRIPTION OF THE INVENTION

Figure 1:
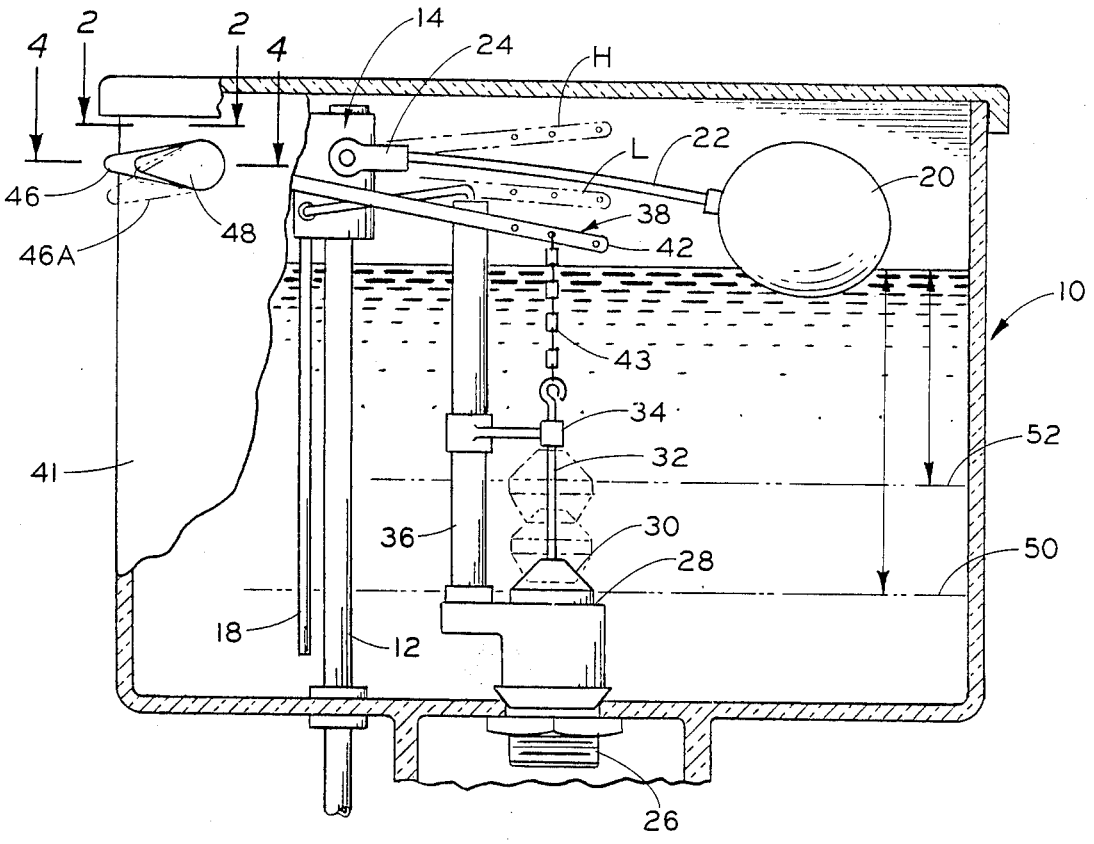
FIG. 1 illustrates a cross-section of a conventional flush tank and flush mechanism with the apparatus of the present invention shown in place.
Figure 2:
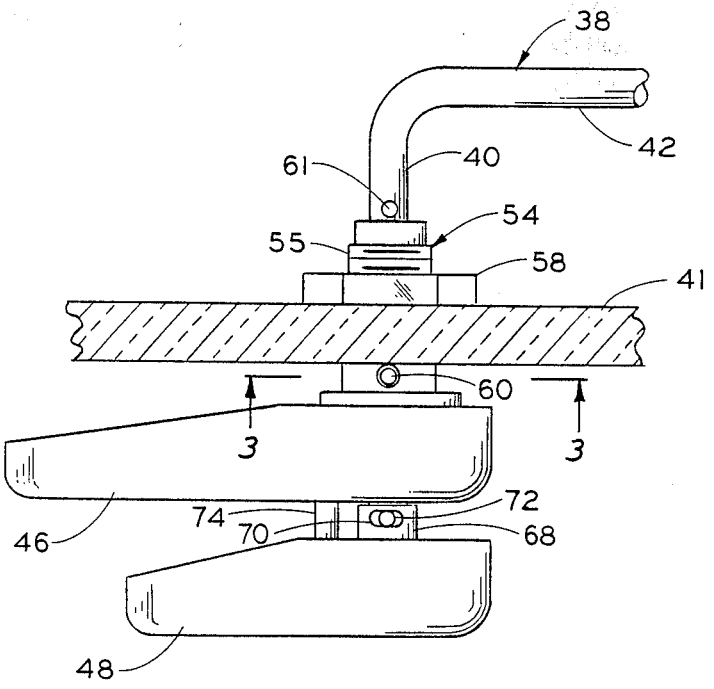
FIG. 2 is an enlarged plan view of the flush apparatus, partially sectioned taken in the direction of lines 2—2 of FIG. 1.
Figure 3:
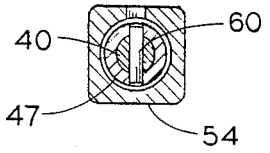
FIG. 3 is a cross-sectional view taken along lines 3—3 of FIG. 2.
Figure 4:
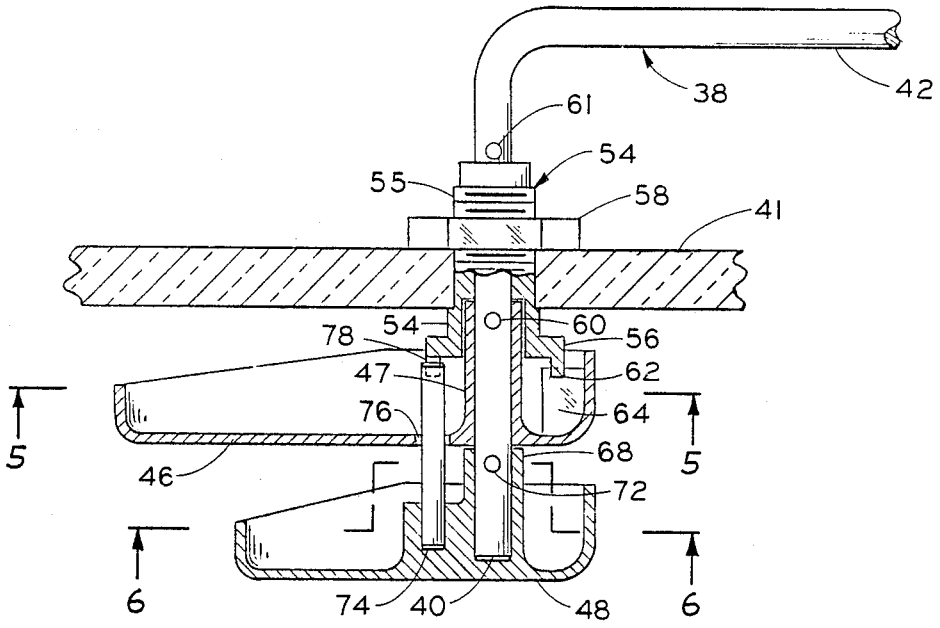
FIG. 4 is a cross-sectional view taken along lines 4—4 of FIG. 1.

Illustrated in FIG. 1 is a conventional flush tank generally depicted by the numeral 10, to which the present invention has been applied. The flush tank 10 contains a water supply conduit 12 having a valve housing, generally depicted by reference numeral 14 at the upper end, containing a conventional float control valve (not shown) through which the water is discharged into the tank through a fill pipe 18. The valve contained in housing 14 is controlled in the usual way by a float 20 which is connected to the valve through an operating linkage which includes a rocker arm 22 and an intermediate pivot link 24. The float controlled valve thus admits water to the tank 10 when the float 20 drops below a certain selected level, and shuts off the flow of water to the tank 10 by closing the float control valve when the float 20 rises back to that selected level.

The tank contains a discharge outlet 26 in its bottom wall which communicates with the toilet bowl to be flushed (not shown). The discharge outlet 26 is provided with a valve seat 28 in which a valve, as a ball valve 30 seats to occlude the flow of water through the passage 26. The ball valve 30 is usually made of rubber or a flexible elastomer having a dome-like hollow body with an opening in its lower surface (not shown) so that it is capable of receiving water therein to increase its weight so as to insure its positive fall onto and into closing engagement with the seat 28. Extending upward from the ball 30 is a rigid elongated wire hook member 32 passing through a bearing eyelet 34 fixedly mounted on a vertical overflow pipe 36.

The ball 30 is thus held in alignment with the seat 28, and is permitted to be easily raised and released to lower relative thereto, by an L-shaped lifting rod, generally bearing numeral 38. The lifting rod has its short leg 40 journalled for rotation in the front wall 41 of the tank 10. Its long leg 42 extends over the ball 30 and is connected thereto by a flexible chain 43. This enables lifting control of the ball valve 30 and permits the same to seat in closing engagement with the seat 28 when the long leg 42 is released.

Most flush mechanisms employ the simple ball valve 30 as shown although there are a considerable number of installations which employ a pivotable flap valve. In any event, the manner of lifting and allowing the ball or flap valve to fall freely is the same and it is, therefore, intended that the apparatus thus far described be taken as illustrative only of the basic mechanism that is known and that other conventional modes and parts, well known in this art can also be used.

The apparatus of the present invention is intended to regulate the amount of water allowed to flow or pass out of the tank during each flushing operation by controlling the angle at which the lifting rod 38 is raised and consequently the degree through which the ball 30 is lifted from its seat 28. This is effected by mounting a first or primary handle 46 and a second or auxiliary handle 48, in tandem, on the exposed short leg 40 of the lifting rod 38. Each of the handles 46 and 48 is independently adapted to cause the lifting rod 38 to be pivoted about the axis of its short leg 40, to a high or low angle as seen in phantom lines H and L, respectively in FIG. 1.

Depending on this degree of lift, the ball 30 will either rise high in the water until all the water in the tank is discharged as in the fully raised position H, or it will remain immersed low within the water, and weighted so that it will readily fall back on its seat 28 from its position L, to close the discharge passage 26 before all the water is, in fact, discharged. Thus, either a large volume of water or a lesser volume of water is discharged as illustrated by the residual water levels 50 and 52 respectively.

In accord with the present invention, the one handle 46 forms the primary means for actuating the lifting rod 38 to the standard high angle H while the second handle 48 forms the auxiliary means for actuating the lifting rod 38 to the smaller partially raised angle L. Both the handles 46 and 48 are attached in tandem to the short leg 40 of the lifting rod 38. The auxiliary or second handle 48 is preferably mounted externally of the primary handle so it is most readily accessible for use. It may also be smaller or more distintively shaped than the primary handle 46 so that the user is readily aware of its intended function.

As seen in detail in FIGS. 2–6, the short leg 40 of the lifting rod 38 is journaled within the wall 41 of the tank 10 within a support and guide bushing 54. The bushing 54 extends through the wall 41 from the exterior or outside thereof into the tank. It has a threaded length 55 that extends into the tank and an enlarged head 56 that abuts and seats against the outer surface of the wall 41. The bushing is secured to the tank wall by a nut 58 tightening thereagainst along the thread 55.

The primary handle 46 is fixedly mounted at its hub 47 to the short leg 40 by set screw or pin 60 so that they will rotate conjointly. The set screw 60 also holds the short leg 40 axially within the bushing 54, although a washer or a stop pin 61 may also be provided interiorly of the bushing 54 to limit the rod 40 from axial movement relative to and within the bushing. The bushing 54 is provided with a first stop 62, formed as an axially protruding tip at its periphery which enters between a pair of relatively spaced webs 64 and 66 integrally formed on the interior of the primary handle 46 and which straddles the stop 62. Alternately, the stop 62 may be formed on the tank itself.

Figure 5:
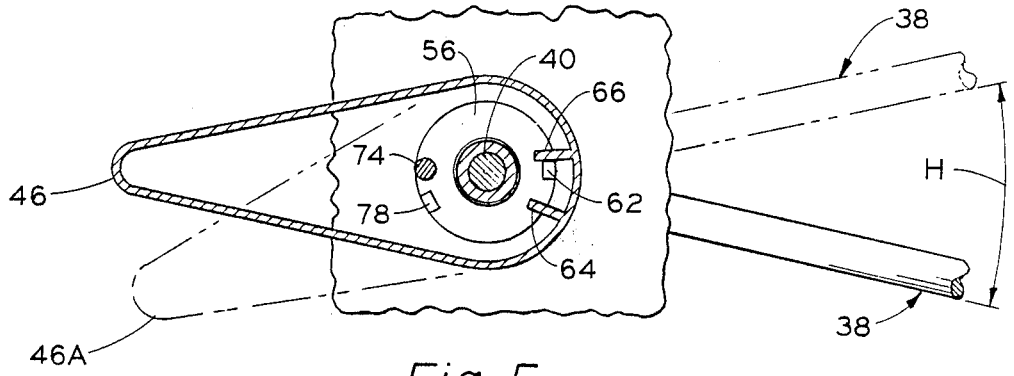
FIG. 5 is a cross-sectional view taken along lines 5—5 of FIG. 4.

On the downward flushing or counter-clockwise movement of the primary handle 46 to the broken line position 46A in FIG. 5, the lower web 64 arcuately rises and engages the stop 62 while in the normal upward or clockwise position of the primary handle 46 (full lines in FIG. 5) the upper web 66 engages the stop 62. Thus, the stop 62 is preferably located that when in engagement with the web 66, the handle 46 is generally horizontal in its normal position. This selective engagement of the webs 64 and 66 with the first stop 62 permits limited arcuate movement of the primary handle 46 as well as the conjoint rotative movement of the lifting rod 38 so that the angular traverse, (arrow h) of the lifting rod 38 is large as seen in FIG. 5. The lifting rod 38 pivotally moves through an arc between a first position where it is fully lowered, allowing the ball 30 to seat in and close the discharge outlet 26 and a second position wherein it is fully raised (as in the phantom outline H in FIG. 1) thereby raising the ball 30 to its full height, sufficient to float on the discharging water.

The auxiliary handle 48, on the other hand, is formed with an axially directed hub 68 having a loose fit over the end of the short leg 40 and is provided with an oblong slot 70 extending generally perpendicular to the axis of the short leg 40. Although the slot 70 is shown as extending diametrically fully through the hub 68, it should be apparent the same is not required, it being sufficient that the slot 70 and pin 72 form a lost-motion connection between the handle 48 and rod 40 thereat. The auxiliary handle 48 is held against axial displacement by the threaded pin 72 passing through the oblong slot 70 into a mating threaded hole in the short leg 40 where it is firmly held.

Integrally formed with the auxiliary handle 48 and extending axially toward the primary handle 46 is a stop or contact bar 74 which projects and extends through an arcuate slot 76 provided in the adjacent surface of the primary handle 46. The slot 76 is of sufficient arcuate extent so as to permit the handle 46 to rotate freely with respect to the handle 48 in a manner which should become obvious as the description proceeds. The cooperation of the contact bar 74 and arcuate slot 76 permits relative rotative lost motion between the handles 46 and 48 with respect to each other. For example, the lost-motion connection 70, 72 enables the primary handle 46 to rotate the short leg 40 of the lifter rod 38 by reason of their connection at the pin 60 without causing rotation of the short flush auxiliary handle 48. This lost-motion connection is also effected at the contact bar 74 in the arcuate slot 76. Hence, the handle 48 remains in its normal full line horizontal position as shown in FIG. 6 during flushing operation of the primary handle 46.

The arcuate slot 76, being of sufficient length, permits the relative rotation of the handles 46 and 48 even though the contact or stop bar 74 mounted on the handle 48 extends through the handle 46 for engagement with a cooperating axially extending projecting contact or stop 78 formed on the bushing 54. The stop 78 limits the arcuate flushing movement of the second handle 48 when the contact bar or stop 74 comes into engagement therewith during operation of the handle 48.

Figure 6:
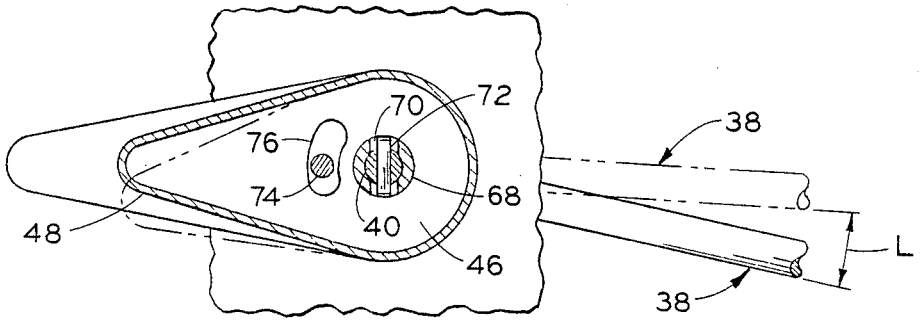
FIG. 6 is a cross-sectional view taken along lines 6—6 of FIG. 4.

When it is desired to perform a short or controlled dispensing flush of water from the tank 10, the operating user may rotate the second handle 48 from its normal inoperative full line horizontal position as shown in FIG. 6 to its downward operative counter-clockwise rotative position as shown in broken lines in FIG. 6. During this operating movement of the handle 48, the right hand end of the slot 70 provided in the hub 68 is brought into operating engagement with the pin 72 mounted to the leg 40 of the lifter rod 38. Continued rotation of the handle 48 causes rotation of the leg 40 to lift the ball valve 30 from the valve seat 28. The handle 48 can be rotated until its motion is stopped by the engagement of its bar 74 with the stop 78.

By predeterminately positioning the cooperating stops 74 and 78, the extent of the lifting movement of the rod 38 may be selectively controlled so that the ball valve 30 is raised sufficiently free of the seat 28 as to produce the flushing release of water from the tank. If the handle 48 is then immediately released by the operator, the ball valve will immediately drop into water occluding seating engagement with the seat to perform a relatively short period of water flush and release a relatively small amount of water as compared to the operation of the handle 46.

However by permitting the raising of the ball valve 30 only a predetermined partial height relative to the seat 28, it is possible to maintain the ball valve 30 fully immersed within the water within the tank 10. Under such condition the ball valve 30 remains fully weighted with water in both its interior and about its exterior. Hence, by operatively depressing and continuing to hold the handle 48 in its downward flush position with the stops 74 and 78 engaged, it is now possible for the user operator to finitely control the amount of water to be released from the tank.

When the desired amount of water is released from the tank into the toilet bowl, the operator need only release the downward pressure on the handle 48. Because the ball valve 30 is still weighted with water as described above, it will immediately fall with the water still flowing out of the valve seat 28 and thereby be pulled and weighted into closing engagement with the valve seat 28 to immediately stop the flow of water therefrom. For as long as the handle 48 is held in its open position, water will continue to flow from the tank into the toilet bowl. However, the provision of the finitely controllable handle 48 provides for an intimate and selected control of the amount of water to be released from the tank into the toilet bowl. This enables the user to finitely control the amount of water to be dispensed from the tank and thereby permits the user to control against the excess loss and dispensing of water when a full flush of the toilet bowl is not required.

Various modifications and changes have been described and others will be obvious to those skilled in the art. Accordingly, it is intended that the disclosure and drawings be taken as illustrative only and not as limiting of the present invention.

What is claimed is:

1. In a toilet flush tank, mechanism having a lifting rod for raising a ball actuated by a pair of handles attached to the lifting rod on the exterior of the water tank, the improvement wherein one of said handles is fixedly secured to said lifting rod to conjointly move the same therewith, and the other of said handles to said lifting rod comprising a pin extending through said other handle and an enlarged slot connection formed in said lifting rod to permit limited arcuate movement relating to said one handle so that said other handle is initially freely rotatable about said lifting rod through a predetermined arc and thereafter to cause said lifting rod to move conjointly therewith, support means on said said tank for supporting said lifting rod and cooperating stop means on said support means and on said handle for limiting the movement of each handle, independently of the other and relating to said tank.

2. In a toilet flush tank as in claim 1, wherein said support means comprises a threaded bushing through which said rod is journalled, said bushing being fixedly secured to said tank and being provided with tabs circumferentially spaced about its periphery forming said stop means thereon for the respective handles.

3. In a toilet flush tank as in claim 1, said stop means on the other of said handles extend through said one handle for engagement with the associcated stop means on said support means.

4. In a toilet flush tank as in claim 3, said one handle having an arcuate slot through which said stop means on said other handle extends so as to permit rotative movement of each of said handles relative to each other.

5. In a toilet flush tank as in claim 2, wherein the stop means on said one handle comprises a pair of radially extending webs formed on the interior surface of said handle, said webs straddling the cooperating stop means on said support bushing.

6. In a toilet flush tank as in claim 5, wherein one of said webs on said one handle is positioned so that the same is in engaging cooperation with said stop means on said bushing when said handle extends horizontally.

7. In a toilet flush tank as in claim 4, wherein said lifting rod is a unitary member having an L-shape, the long leg of which extends parallel to the wall of said tank and the short leg of which extends through said support bushing.

8. Toilet flush apparatus having a tank normally filled with water to a prescribed level, a discharge opening at its bottom, a ball closing the discharge opening and adapted to be lifted to permit water from the tank to pass through the discharge opening and flush control apparatus for regulating the amount of water flushed from the tank comprising a lifting rod mounted in said tank above said ball and having one end connected by a chain to said ball and its other end passing through the wall of said tank, a first handle fixedly secured to the other end of said lifting rod by which said lifting rod can be actuated in direct movement therewith, a second handle located about the other end of said lifting rod in tandem with said first handle and means cooperating to form a lost motion connection between said second handle and the other end of said lifting rod so as to allow said second handle to rotate from an initial position freely of said lifting rod to a second position engaging with the other end of said lifting rod so that further rotation of said second handle causes pivoting of said lifting rod about a distance less than that caused by actuation of said first handle, a pin and elongated arcuate slot engagement between said second handle and the other end of said lifting rod such that said second handle may be pivoted for an arcuate distance without effecting pivoting of said lifting rod, and including a first set of cooperating stop means fixed with respect to said tank and said other handle for limiting the conjoint movement of said lifting rod and said other handle for a predetermined arcuate distance after completion of said lost motion movement, whereby actuation of said first handle raises said ball to a first level, permitting a predetermined amount of water to be discharged, and actuation of said second handle raises said ball to a second level, permitting less than said predetermined amount of water to be discharged.

9. The apparatus as in claim 8, wherein said cooperating stop means comprises a stop pin extending substantially parallel to said one end of said lifting rod and passing through said first handle into engagement with the stop means on said tank.

10. The apparatus as in claim 9, wherein said first handle is formed with an arcuate slot through which said stop pin passes permitting said second handle to move free of said first handle, through said lost motion movement and said predetermined arcuate distance of conjoint movement with said lifting rod.

11. The apparatus as in claim 8, including a second set of cooperating stop means on said tank and said first handle for limiting the conjoint movement of said first handle and lifting rod between a first position in which said lifting rod assumes a downward non-operative position and an upward fully raised position.

12. The apparatus as in claim 11, including a second set of cooperating stop means including a tab extending from said tank and a pair of walls formed on the inner surface of said first handle, straddling said tab.

13. The apparatus as in claim 11, including a bushing fixedly secured in the wall of said tank and through which said one end said lifting rod is journalled said bushing being provided with circumferentially spaced tabs forming said stop means of said tank in said first and second set respectively.

14. Apparatus for controlling the amount of water discharged from a flush tank comprising a valve seat at the bottom of said tank, a ball valve element mounted over said seat to normally occlude said seat and being liftable to permit passage of water therethrough, a lifting rod having one end extending over said ball valve element and having its other end extending freely exteriorly through the wall of said tank, means connecting said one end of said rod to said ball valve element, a first pivotable handle fixedly secured to the free end of said lifting rod by which said lifting rod is conjointly pivotable directly therewith, through the same degree of arc as the first handle is pivoted, means for limiting the conjoint pivotal movement of said lifting rod and said first handle within a predetermined arc defined by a first position wherein said ball valve element fully closes said valve seat and a second position wherein said ball valve element is fully removed from said valve seat, and a second pivotal handle secured to the free end of said lifting rod, said second handle being secured to said rod by a pin integrally fixed on said second handle and extending through an oblong slot in the free end of said lifting rod, said oblong slot extending in the direction of rotation of said lifting rod and having a length less than the distance of said arc of rotation or said second handle, so as to enable said second handle to be freely rotatable about said lifting rod for an arcuate distance less than said predetermined arc and thereafter engageable to cause said lifting rod to lift said valve element only partially between said fully closed and fully opened position, a bushing fixedly mounted in the wall of said tank through which the other free end of said lifting rod is journalled, said bushing being provided with a first stop member, and said first handle being provided with a pair of abutment webs adapted to engage said first stop member in the first and second positions of said lifting rod respectively, said bushing including second stop means for limiting the arcuate movement of said second handle.

* * * * *